US009121221B2

(12) United States Patent
Cheng

(10) Patent No.: US 9,121,221 B2
(45) Date of Patent: Sep. 1, 2015

(54) CORD-WINDING ASSEMBLY OF A WINDOW BLIND

(71) Applicant: Li-Ming Cheng, Kaohsiung (TW)

(72) Inventor: Li-Ming Cheng, Kaohsiung (TW)

( * ) Notice: Subject to any disclaimer, the term of this patent is extended or adjusted under 35 U.S.C. 154(b) by 217 days.

(21) Appl. No.: 13/903,016

(22) Filed: May 28, 2013

(65) Prior Publication Data

US 2014/0352895 A1 Dec. 4, 2014

(51) Int. Cl.
*E06B 9/322* (2006.01)
*E06B 9/262* (2006.01)

(52) U.S. Cl.
CPC ..... *E06B 9/322* (2013.01); *E06B 9/262* (2013.01); *E06B 2009/3227* (2013.01)

(58) Field of Classification Search
USPC ..... 160/170, 84.04, 190, 193, 171; 242/602–603
IPC ..... E06B 2009/3225,2009/3227
See application file for complete search history.

(56) References Cited

U.S. PATENT DOCUMENTS

| | | | | | |
|---|---|---|---|---|---|
| 13,251 | A * | 7/1855 | Bixler | 160/170 |
| 821,708 | A * | 5/1906 | Edward | 242/602.2 |
| 1,621,714 | A * | 3/1927 | Dyer et al. | 242/603 |
| 1,626,322 | A * | 4/1927 | Bell | 242/603 |
| 2,420,301 | A * | 5/1947 | Cusumano | 160/170 |
| 2,633,629 | A * | 4/1953 | Crookston | 29/894.2 |
| 2,732,150 | A * | 1/1956 | Bus | 242/602.2 |
| 2,741,441 | A * | 4/1956 | Bus, Sr. | 242/602.2 |
| 3,272,454 | A * | 9/1966 | Lane et al. | 242/602.2 |
| 3,391,879 | A * | 7/1968 | Bus, Sr. | 242/602.2 |
| 6,283,192 | B1 | 9/2001 | Toti | |
| 6,945,302 | B2 * | 9/2005 | Nien | 160/170 |
| 7,228,797 | B1 * | 6/2007 | Hillman et al. | 100/170 |
| 2008/0053627 | A1 * | 3/2008 | Lin | 160/170 |
| 2013/0112353 | A1 | 5/2013 | Sengelaub | |

* cited by examiner

*Primary Examiner* — David Purol

(74) *Attorney, Agent, or Firm* — Alan D. Kamrath; Kamrath IP Lawfirm, P.A.

(57) ABSTRACT

A cord-winding assembly of a window blind includes a first spool and a second spool. The first spool has a first axis extending in an axial direction. A plurality of first grooves is formed on an outer periphery of the first spool. The first grooves are parallel to each other. Each of the plurality of first grooves has a circumferential length different from other first grooves. The second spool has a second axis extending in the axial direction. The first and second axes are parallel to each other. A plurality of second grooves is formed on an outer periphery of the second spool. The second grooves are parallel to each other.

10 Claims, 8 Drawing Sheets

CORD-WINDING ASSEMBLY OF A WINDOW BLIND

BACKGROUND OF THE INVENTION

1. Field of the Invention

The present invention generally relates to an assembly of a window blind and, more particularly, to a cord-winding assembly of the window blind that allows the user to smoothly raise or lower a window cover of the window blind using less strength.

2. Description of the Related Art

Referring to FIG. 1, U.S. Pat. No. 6,283,192 discloses a flat spring drive system and a window cover having two spools 91*a* and 91*b*. Both spools 91*a* and 91*b* are in a conical form and have a large end with a relatively larger diameter, as well as a small end with a relatively smaller diameter. The two spools 91*a* and 91*b* are positioned upside down with respect to each other, such that the large end of spool 91*a* is aligned with the small end of spool 91*b*, and the small end of spool 91*a* is aligned with the large end of spool 91*b*. A spiral groove is formed on an outer surface of each spool 91*a*/91*b* and extends from the large end to the small end thereof. A cord 92 is wound along the spiral grooves of the spools 91*a* and 91*b*.

During use, the flat spring drive system is installed in the housing of an upper head rail 93. Upper head rail 93 includes a spring unit 95 connected to spool 91*a* via a gear unit 94, as well as a pulley 97 connected to spool 91*b* via another gear unit 96. In this structure, when the user raises a bottom rail of the flat spring drive system (not shown), spring unit 95 will drive gear unit 94 to rotate under its elastic force, thereby controlling the winding of cord 92 between spools 91*a* and 91*b*. At the same time, gear unit 96 is also driven so that pulley 97 is able to collect a lift cord "C" that extends through a plurality of slats of the window cover. In this regard, gear unit 94 controls spring unit 95 so that spring unit 95 is able to dynamically release sufficient elastic force to support the weight of the plurality of slats.

In the above structure, both spools 91*a* and 91*b* have a spiral groove 911 on its outer circumferential surface, so that cord 92 can be continuously wound around spools 91*a* and 91*b* along spiral grooves 911. However, each round of spiral groove 911 can receive only one turn of cord 92. Thus, when the length of the window cover is increased, the required length of lift cord "C" is also increased. In this case, the height of each spool 91*a*/91*b* should be increased so that a larger number of turns of lift cord "C" can be wound around spools 91*a* and 91*b*. However, since the interior space of the housing of upper head rail 93 is limited, the height of each spool 91*a*/91*b* cannot be increased as desired. In light of this problem, it is necessary to use gear units 94 and 96 in the flat spring drive system to provide a torque-changing effect. Based on the torque-changing effect, pulley 97 can be driven to dispense or collect the long cord (lift cord "C") using the short cord (cord 92). Disadvantageously, use of gear units 94 and 96 will lead to an inconvenient assembly and an increment in cost of the system. In light of this, it is necessary to improve the conventional flat spring drive system.

SUMMARY OF THE INVENTION

It is therefore the objective of this invention to provide a cord-winding assembly that can be wound with a much larger length of the cord without having to increase the heights of the spools of the cord-winding assembly.

In an embodiment, a cord-winding assembly of a window blind is disclosed. The cord-winding assembly comprises a first spool and a second spool. The first spool has a first axis extending in an axial direction. A plurality of first grooves is formed on an outer periphery of the first spool. The first grooves are parallel to each other. Each of the plurality of first grooves has a circumferential length different from other first grooves. The second spool has a second axis extending in the axial direction. The first and second axes are parallel to each other. A plurality of second grooves is formed on an outer periphery of the second spool. The second grooves are parallel to each other.

In a preferred form shown, each of the plurality of second grooves has a circumferential length different from other second grooves.

In the preferred form shown, the first spool has at least one axial groove extending through the plurality of first grooves.

In the preferred form shown, the second spool has at least one axial groove extending through the plurality of second grooves.

In the preferred form shown, the first spool has at least one axial groove extending through the plurality of first grooves thereof, and the second spool has at least one axial groove extending through the plurality of second grooves thereof.

In the preferred form shown, the at least one axial groove comprises a plurality of axial grooves.

In the preferred form shown, the axial grooves are annularly spaced from each other in even distances on the outer periphery of the first spool.

In the preferred form shown, the first spool comprises a shaft tube portion extending through two ends of the first spool in the axial direction. The plurality of first grooves extends in a radial direction perpendicular to the axial direction on the outer periphery of the first spool. The second spool comprises a shaft tube portion extending through two ends of the second spool in the axial direction. The plurality of second grooves extends in the radial direction perpendicular to the axial direction on the outer periphery of the second spool.

In the preferred form shown, the cord-winding assembly further comprises a cord. The first spool has a large end and a small end. The large end has a diameter larger than a diameter of the small end. The first spool has a cord-retaining hole at the large end thereof. The second spool has a cord-retaining hole aligned with the small end of the first spool in a radial direction perpendicular to the axial direction. The cord has two ends fixed in the cord-retaining holes of the first and second spools, respectively.

In the preferred form shown, the first spool has a large end and a small end. The large end has a diameter larger than a diameter of the small end. The second spool has a large end and a small end. The large end of the second spool has a diameter larger than a diameter of the small end of the second spool. The large end of the second spool is aligned with the small end of the first spool in a radial direction perpendicular to the axial direction. The small end of the second spool is aligned with the large end of the first spool in the radial direction perpendicular to the axial direction.

In the preferred form shown, the cord-winding assembly further comprises a cord. Both the first and second spools have a cord-retaining hole at the large end thereof. The cord has two ends fixed in the cord-retaining holes of the first and second spools, respectively.

In the preferred form shown, the cord-winding assembly is connected to a spring assembly via a spool assembly. The spring assembly comprises two spring spools and a spring having two ends fixed to the two spring spools, respectively. The two spring spools are parallel to each other. The spool assembly comprises a first cord spool, a second cord spool and a cord having two ends fixed at the first and second cord spools, respectively. The first cord spool is connected to one of the two spring spools of the spring assembly, and the second cord spool is connected to the small end of the first spool of the cord-winding assembly.

In the preferred form shown, the cord-winding assembly further comprises a pulley connected to the large end of the second spool.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
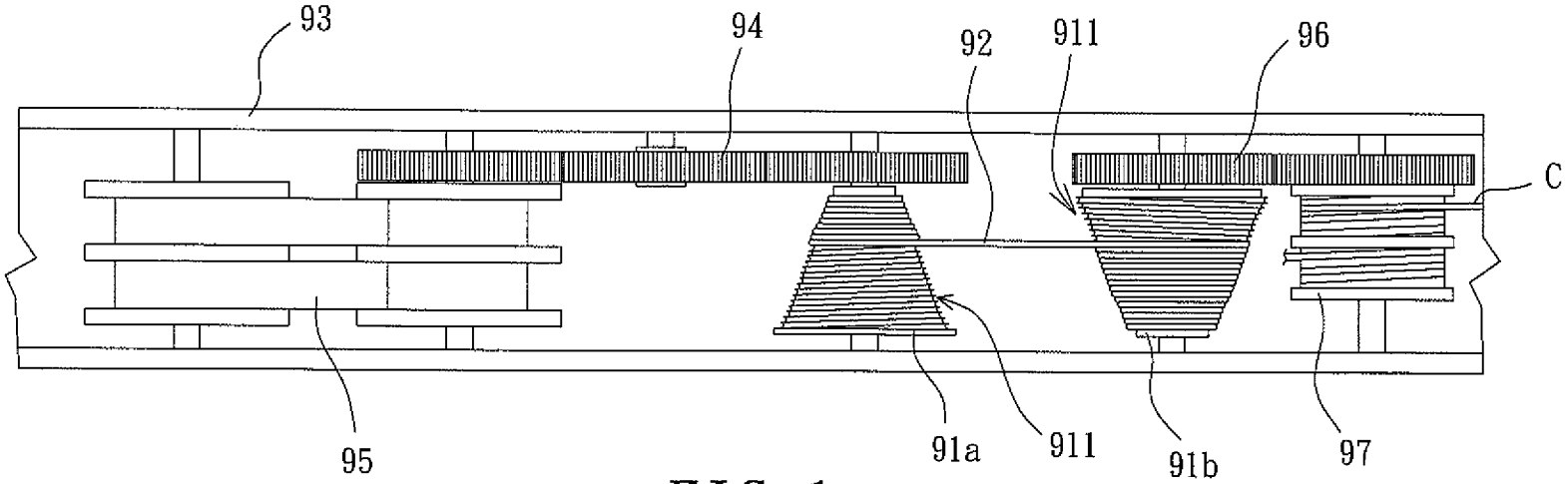
FIG. 1 PRIOR ART
FIG. 1 shows a conventional flat spring drive system and window cover.

In the various figures of the drawings, the same numerals designate the same or similar parts. Furthermore, when the terms "first", "second", "third", "fourth", "inner", "outer", "top", "bottom", "front", "rear" and similar terms are used hereinafter, it should be understood that these terms have reference only to the structure shown in the drawings as it would appear to a person viewing the drawings, and are utilized only to facilitate describing the invention.

DETAILED DESCRIPTION OF THE INVENTION

Figure 2:
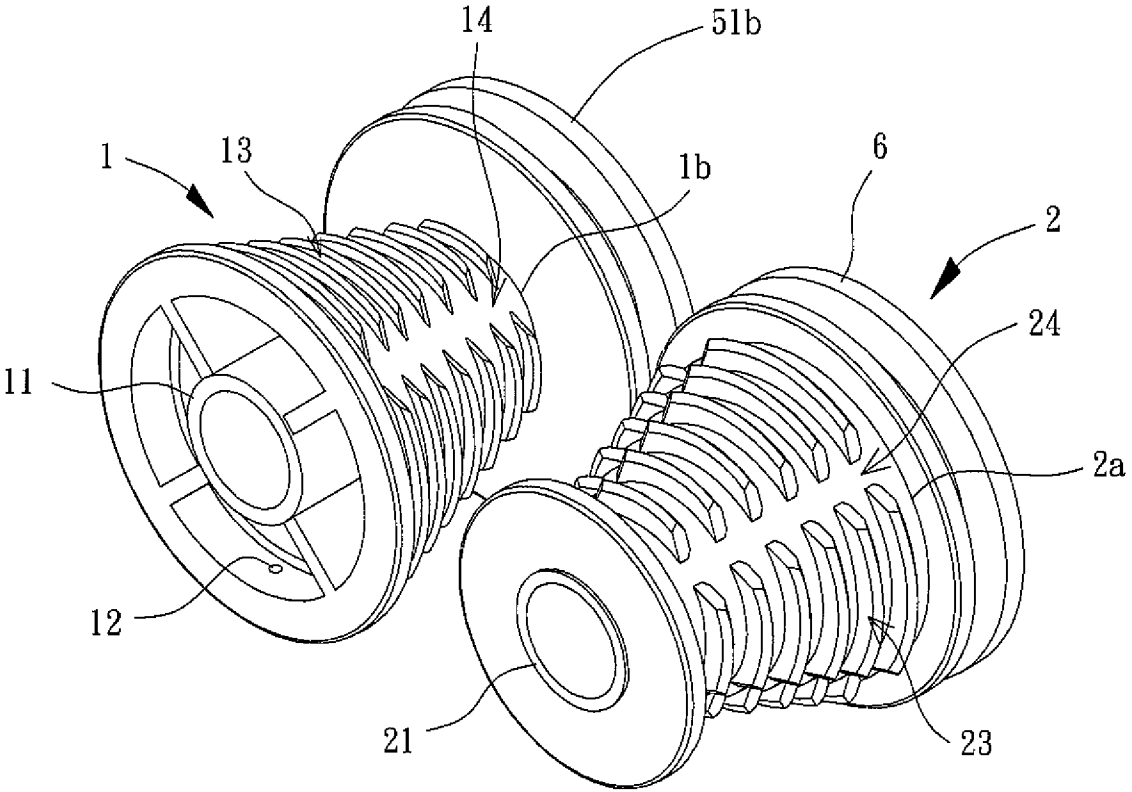
FIG. 2 shows a cord-winding assembly of a window blind according to a first embodiment of the invention with the cord-winding assembly connected to a cord spool and a pulley.
Figure 3:
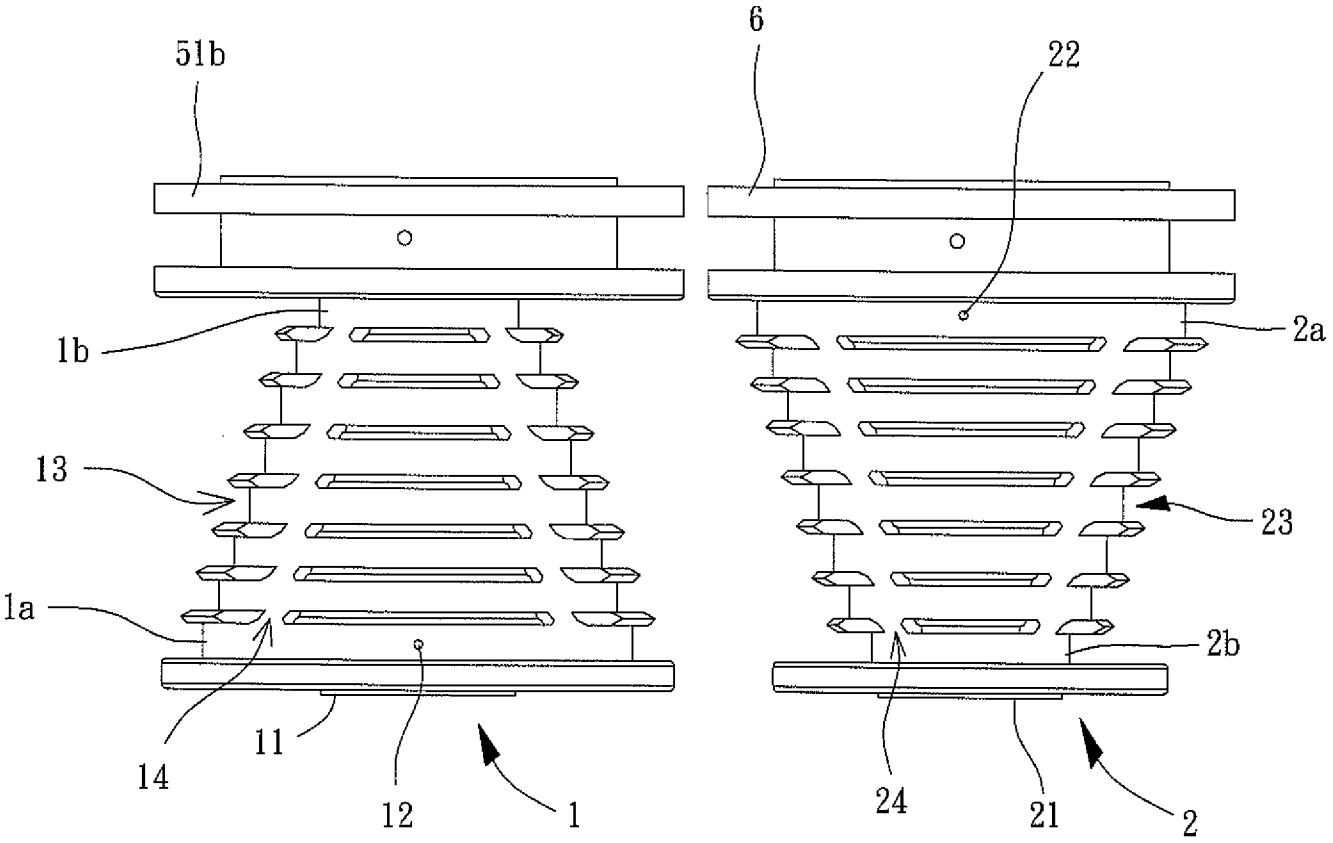
FIG. 3 is a cross-sectional view of the device shown in FIG. 2.

FIGS. 2 and 3 show a cord-winding assembly of a window blind according to a first embodiment of the invention. The cord-winding assembly of the window blind is comprised of a first spool 1 and a second spool 2 aligned with first spool 1 in a radial direction. Specifically, first spool.1 has a first axis extending therethrough in an axial direction of the cord-winding assembly, and second spool 2 has a second axis extending therethrough in the axial direction of the cord-winding assembly. The first and second axes are parallel to each other. The cord-winding assembly of the window blind further comprises a cord 3 (shown in FIG. 4) wound around first and second spools 1 and 2. Cord 3 drives first and second spools 1 and 2 to rotate synchronously. As such, cord 3 can be wound between first and second spools 1 and 2.

First spool 1 has a large end 1a with a relatively larger diameter, as well as a small end 1*b* with a relatively smaller diameter. Large end 1*a* has a larger circumferential length than small end 1*b*. Based on the size difference between large end la and small end 1*b*, first spool 1 is able to provide a torque-changing function. First spool 1 is preferably in the form of a cone, so that cord 3 can be wound with first spool 1 more smoothly. First spool 1 further includes a shaft tube portion 11 extending through large end la and small end 1*b* in an axial direction. A cord -retaining hole 12 is arranged at large end 1*a* of first spool 1, so that one end of cord 3 can be retained in cord-retaining hole 12. A plurality of parallel grooves 13 can be arranged on an outer periphery of first spool 1 for winding purposes of cord 3. The width and depth of each groove 13 are not limited to any values and can be adjusted as desired. The plurality of grooves 13 may extend in an oblique direction on the outer periphery of first spool 1 with respect to a radial direction perpendicular to the axial direction. Alternatively, the plurality of grooves 13 may also extend in the radial direction on the outer periphery of first spool 1 (i.e. extends perpendicular to the axial direction), so that a larger quantity of grooves 13 can be arranged on the outer periphery of first spool 1.

First spool 1 may further include at least one axial groove 14 extending through the plurality of grooves 13, so that the plurality of grooves 13 is in communication with each other. In this regard, when a groove 13 is fully wound with cord 3, cord 3 can be directed to the other adjacent groove 13 via the axial groove 14. In this embodiment, the at least one axial groove 14 may include a plurality of axial grooves 14 annularly spaced from each other in even distances on the outer periphery of first spool 1. In this structure, when a groove 13 is fully wound with cord 3, cord 3 can be directed to the other adjacent groove 13 via the most adjacent axial groove 14, achieving smooth winding of cord 3.

The structure of second spool 2 is substantially the same as that of first spool 1. In other words, second spool 2 may also have a large end 2*a* with a relatively larger diameter, as well as a small end 2*b* with a relatively smaller diameter. Based on the size difference between large end 2*a* and small end 2*b*, second spool 2 is able to provide a torque-changing function. At this point, first and second spools 1 and 2 are able to provide double torque-changing effects, enhancing the overall torque-changing effect of the cord-winding assembly. Advantageously, the cord-winding assembly is suitable for use with a heavier window shade which requires a high torque-changing ratio, such as a large-sized window blind. Since first and second spools 1 and 2 are positioned upside down with respect to each other, large end 1*a* of first spool 1 is aligned with small end 2*b* of second spool 2, and small end 1*b* of first spool 1 is aligned with large end 2*a* of second spool 2.

Furthermore, second spool 2 is preferably in the form of a cone and includes a shaft tube portion 21 extending through large end 2*a* and small end 2*b* in an axial direction. A cord-retaining hole 22 is arranged at large end 2*a* of second spool 2, so that another end of cord 3 can be retained in cord-retaining hole 22. A plurality of grooves 23 can be arranged on an outer periphery of second spool 2 for winding purposes of cord 3. The width and depth of each groove 23 are not limited to any values and can be adjusted as desired. The plurality of grooves 23 may extend in an oblique direction on the outer periphery of second spool 2. Alternatively, the plurality of grooves 13 may also extend in the horizontal direction on the outer periphery of first spool 1. Second spool 2 may further include at least one axial groove 24 extending through the plurality of grooves 23, so that the plurality of grooves 23 is in communication with each other. The at least one axial groove 14 may include a plurality of axial grooves 14 annularly spaced from each other in even distances on the outer periphery of second spool 2.

Based on the above structure, the cord-winding assembly of the window blind in the first embodiment is characterized in that each groove 13/23 can be wound with a plurality of turns of cord 3 until the groove 13 or 23 becomes full. When groove 13/23 is full, cord 3 is directed to the other adjacent groove 13/23 to continuously wind the cord 3. Since each groove 13/23 can be wound with a plurality of turns of cord 3, the length of cord 3 that can be wound around first and second spools 1 and 2 is significantly increased without increasing the heights of first and second spools 1 and 2.

Based on this, when the cord-winding assembly of the window blind is installed in the housing of an upper head rail of the window blind, it is no longer necessary to connect the cord-winding assembly to other components of the window blind via complex gear units. As an example of FIG. 4, the cord-winding assembly can be installed in a retractable window blind which provides higher security to children using the system, and the cord-winding assembly is connected to a spring assembly 4 via a simple spool assembly 5. Spring assembly 4 is comprised of two spring spools 41*a* and 41*b* and at least one spring 42. Two ends of spring 42 are fixed to the two spring spools 41*a* and 41*b*, respectively. Spool assembly 5 is comprised of two cord spools 51*a* and 51*b* and a cord 52. Cord 52 has two ends fixed to the two cord spools 51*a* and 51*b*, respectively. Cord spool 51*a* synchronously rotates with spring spool 41*a*, and cord spool 51*b* synchronously rotates with first spool 1.

In this embodiment, cord spool 51*a* may be integrally formed with spring spool 41*a*, and cord spool 51*b* may also be integrally formed with first spool 1, to simplify the structure for easy assembly. In this structure, stable synchronous rotation of said components is ensured. More specifically, referring to FIGS. 2 and 3, cord spool 51*b* may be connected to small end 1*b* of first spool 1. Cord spool 51*b* is preferably coaxial with first spool 1, so that cord spool 51*b* and first spool 1 are able to synchronously rotate with respect to a shaft after the shaft is received in shaft tube portion 11. Moreover, large end 2*a* of second spool 2 may be connected to a pulley 6 that is used to dispense or collect lift cord "C". Pulley 6 is preferably coaxial with second spool 2, so that pulley 6 and second spool 2 are able to synchronously rotate with respect to another shaft after the other shaft is received in shaft tube portion 21.

Figure 4:
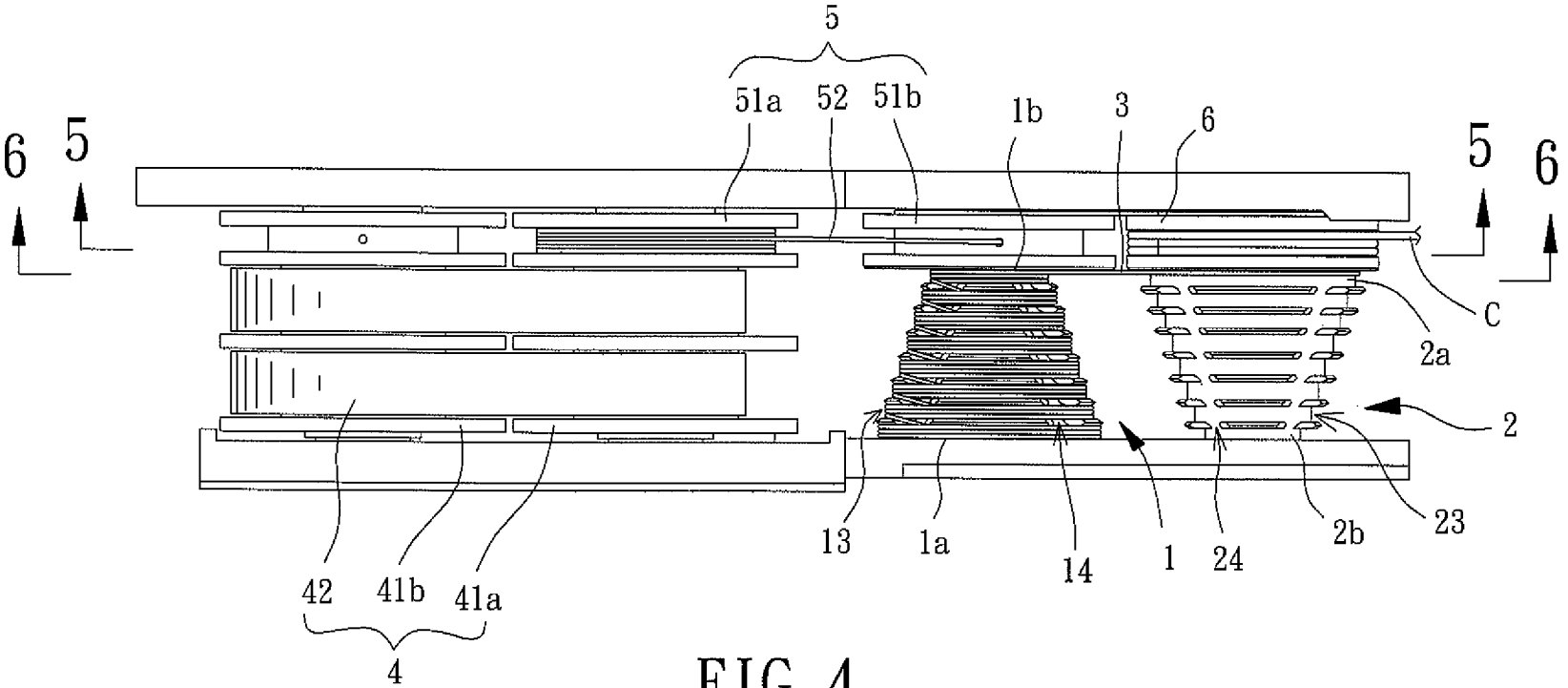
FIG. 4 shows a window blind having the cord-winding assembly of the first embodiment of the invention with the window blind operated in an open condition.
Figure 5:
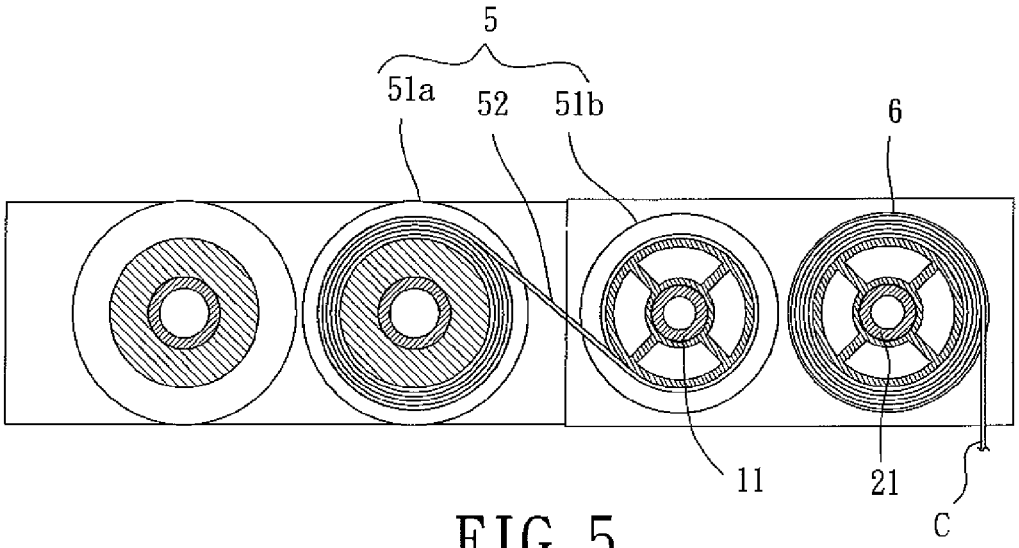
FIG. 5 is a cross-sectional view of the window blind taken along line 5-5 in FIG. 4.
Figure 6:
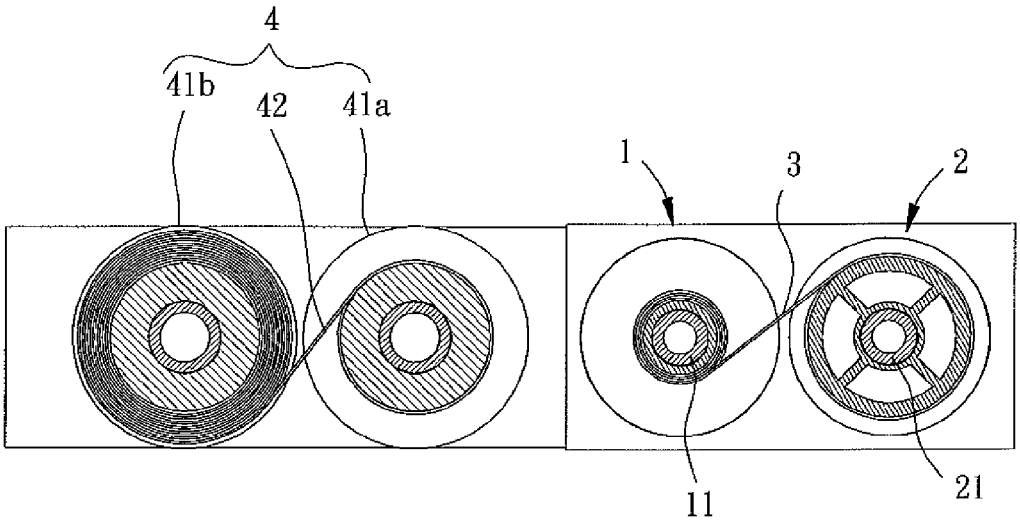
FIG. 6 is a cross-sectional view of the window blind taken along line 6-6 in FIG. 4.

Referring to FIGS. 4 and 5, when the retractable window blind is operated in an open condition where slats of the window blind are raised, the slats are tightly stacked to the top of the window, and the majority of lift cord "C" is wound around pulley 6. At this time, the majority of cord 52 is wound around cord spool 51*a*, and the minority of cord 52 is wound around cord spool 51*b*. Also, referring to FIGS. 4 and 6, the majority of cord 52 is wound along grooves 13 of first spool 1, and the minority of cord 52 is wound around large end 2*a* of second spool 2. In this case, the majority of spring 42 is wound around spring spool 41*b*, and only a small part of spring 42 is stretched to support the weight of the window slats.

As the user pulls down the bottom rail of the retractable window blind to spread out the window slats, lift cord "C" is dispensed from pulley 6, so that second spool 2 rotates synchronously with pulley 6. In this regard, second spool 2 collects cord 3 from first spool 1, driving cord spool 51*b* to collect cord 52 from cord spool 51*a*. Consequently, spring spool 41*a* is driven to collect spring 42 from spring spool 41*a*. Thus, a larger length of spring 42 is stretched to support the weight of the window slats.

When the user pulls lift cord "C", a torque force is applied to second spool 2. The value of the torque force is the product of the pulling force of cord 3 and the arm of force of second spool 2 (the distance between the outer circumferential face and the central axis of second spool 2). Therefore, it can be determined that the value of the torque force is proportional to the arm of force of second spool 2. As cord 3 is continuously wound around second spool 2 while second spool 2 rotates to collect cord 3 from first spool 1, the value of the torque force will be smaller and smaller. This provides an advantage that the larger the length the lift cord "C" is pulled by the user the smaller the strength the user is required to pull the lift cord "C".

Figure 7:
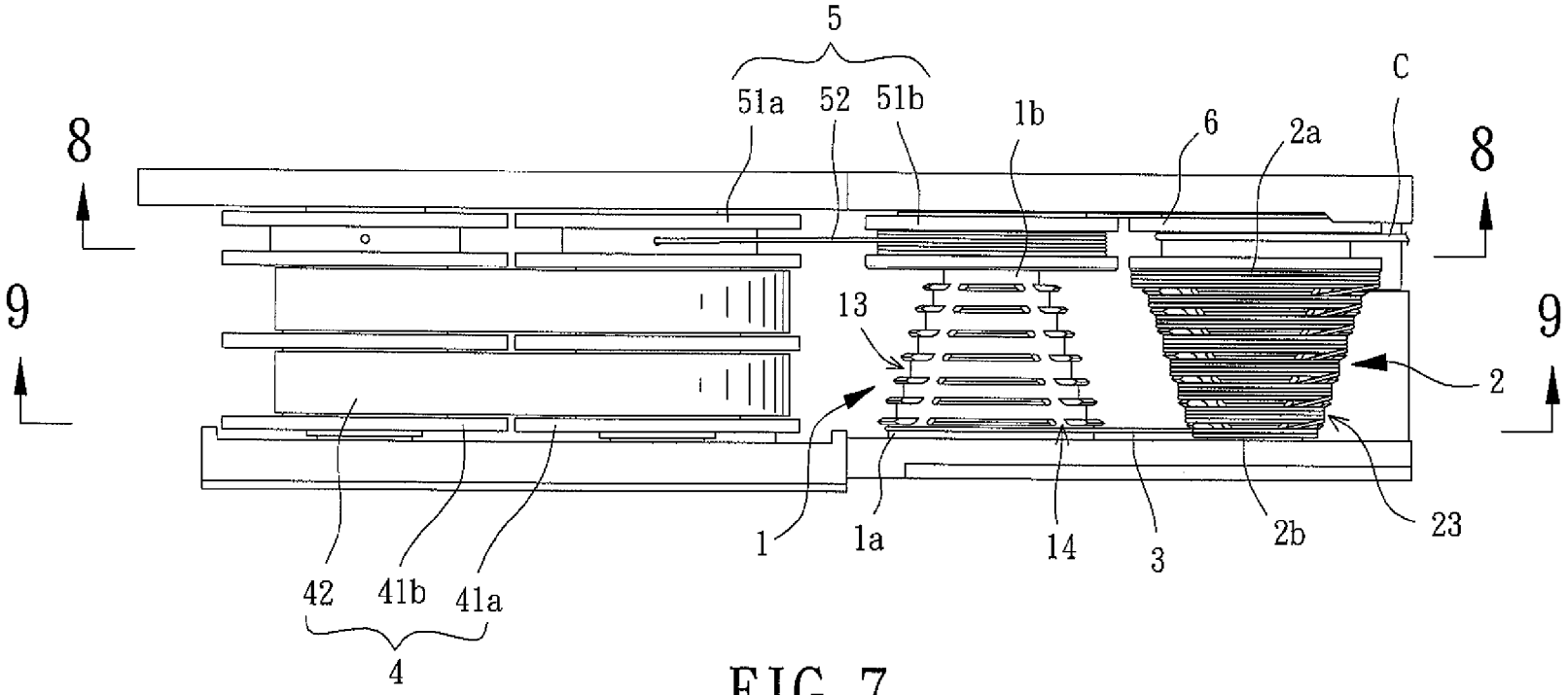
FIG. 7 shows the window blind shown having the cord-winding assembly of the first embodiment of the invention with the window blind operated in a closed condition.
Figure 8:
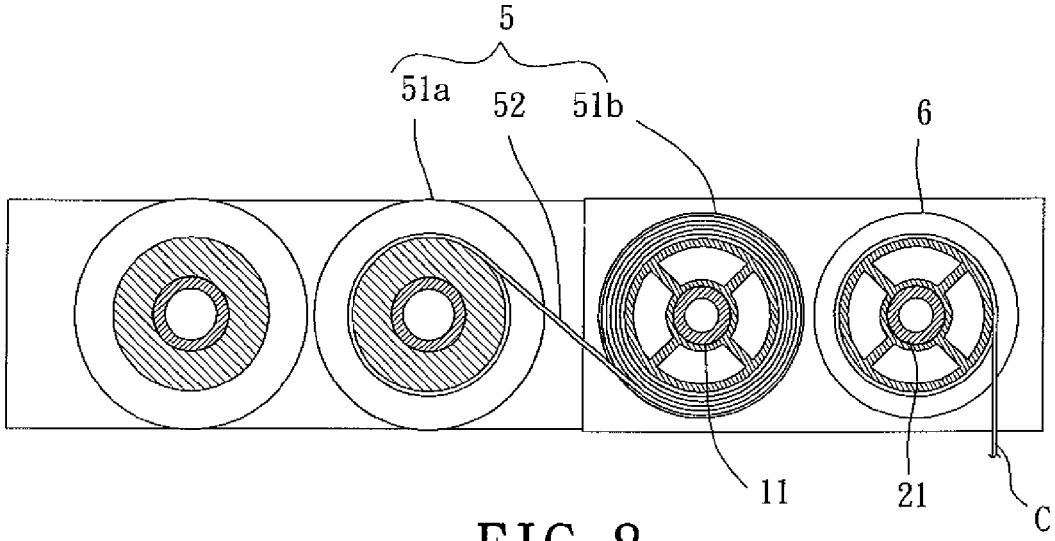
FIG. 8 is a cross-sectional view of the window blind taken along line 8-8 in FIG. 7.
Figure 9:
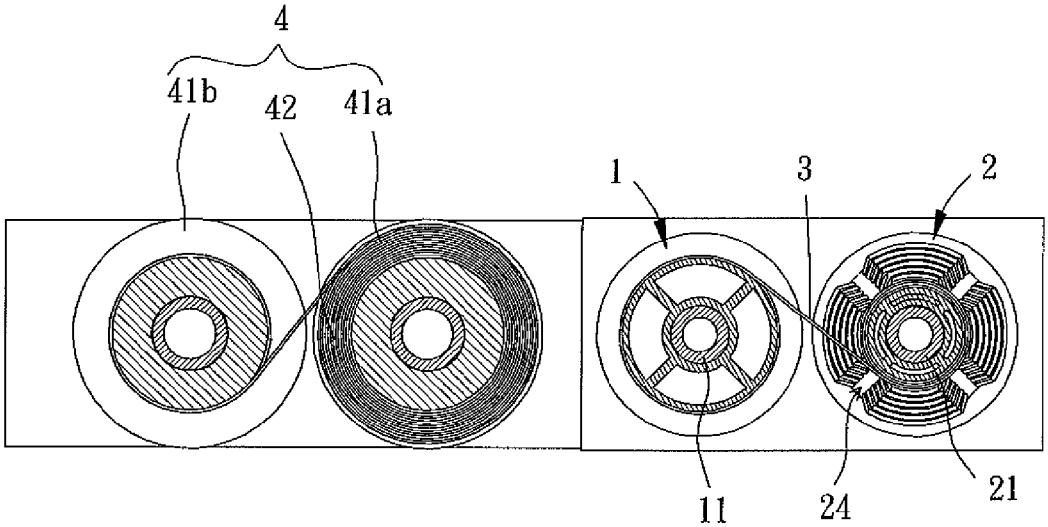
FIG. 9 is a cross-sectional view of the window blind taken along line 9-9 in FIG. 7.

When the bottom rail of the retractable window blind is pulled to the bottom, the slats of the window shade are spread out, so that the retractable window system is operated in a closed condition where the window shade is completely lowered. In this case, referring to FIGS. 7 and 8, the minority of lift cord "C" is wound around pulley 6, the majority of cord 52 is wound around cord spool 51*b*, and the minority of cord 52 is wound around cord spool 51*a*. Referring to FIGS. 7 and 9, the majority of cord 3 is wound along grooves 23 of second spool 2, while the minority of cord 3 is wound around large end 1*a* of first spool 1. In this situation, the majority of spring 42 is wound around spring spool 41*a*, such that a large part of spring 42 is stretched to support the weight of the window slats.

In this structure, when the user raises the bottom rail of the retractable window blind in order to stack the slats tightly to the top of the window, the elastic force of spring 42 will drive spring spool 41*a* to rotate, so that spring spool 41*a* is able to collect spring 42 from spring spool 41*b*. The rotating spring spool 41*a* will drive cord spool 51*a* to collect cord 52 from cord spool 51*b*, as well as driving first spool 1 to collect cord 3 from second spool 2. Finally, pulley 6 is driven to collect lift cord "C".

Figure 10:
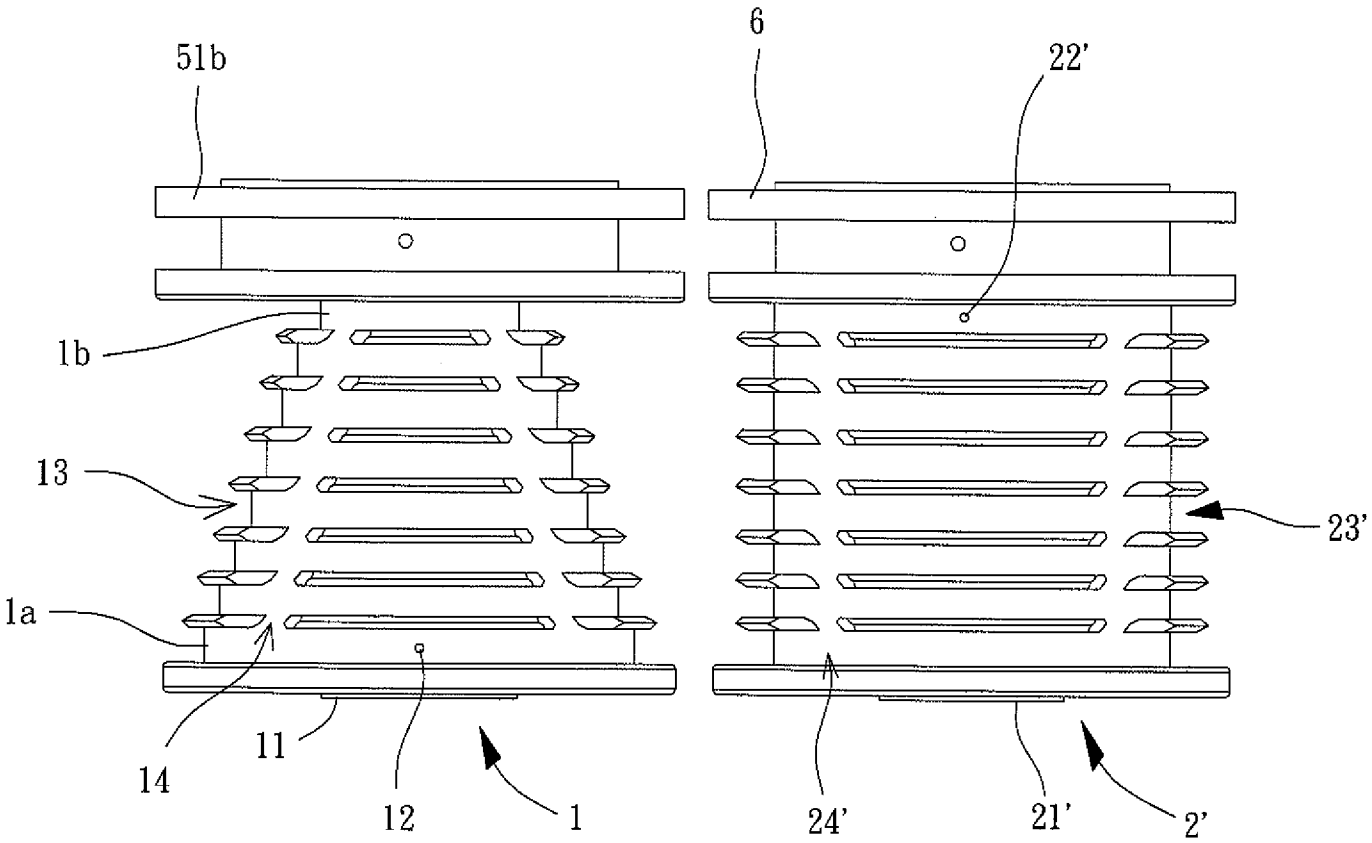
FIG. 10 shows another cord-winding assembly of a window blind according to a second embodiment of the invention with the cord-winding assembly connected to a cord spool and a pulley.

FIG. 10 shows a cord-winding assembly of a window blind according to a second embodiment of the invention. In this embodiment, one of the first and second spools 1 and 2 (such as second spool 2') may be in a cylindrical form. As such, the cord-winding assembly in this embodiment has a smaller torque-changing ratio compared to the cord-winding assembly in the first embodiment. Due to the smaller torque-changing ratio, the cord-winding assembly in the second embodiment is suitable for use with a less heavy window shade which does not require a high torque-changing ratio, such as a large-sized honeycomb shade.

More specifically, the cord-winding assembly in the second embodiment is comprised of a first spool 1 and a second spool 2'. First spool 1 has been described in the first embodiment above. Second spool 2' has a shaft tube portion 21' extending through two ends of second spool 2' in an axial direction. A cord-retaining hole 22' is arranged at one of the two ends of second spool 2', so that one end of cord 3 can be retained in cord-retaining hole 22'. Cord-retaining hole 22' is preferably aligned with small end 1*b* of first spool 1. A plurality of parallel grooves 23' is arranged on an outer periphery of second spool 2'. The width and depth of each groove 23' are not limited to any values and can be adjusted as desired. The plurality of grooves 23' may extend in an oblique direction on the outer periphery of second spool 2'. Alternatively, the plurality of grooves 23' may also extend in the horizontal direction on the outer periphery of second spool 2'. Second spool 2' may further include at least one axial groove 24' extending through the plurality of grooves 23', so that the plurality of grooves 23' is in communication with each other. The at least one axial groove 24' may include a plurality of axial grooves 24' annularly spaced from each other in even distances on the outer periphery of second spool 2'. As such, the cord-winding assembly in the second embodiment can be installed in the housing of the upper head rail of the window blind. The cord-winding assembly in the second embodiment is connected to and operated with other components of the window blind in the same manner as described in the first embodiment above.

It is noted that first and second spools 1 and 2 are not limited to the conical and cylindrical forms described above. In another embodiment, the outer peripheries of first and second spools 1 and 2 may extend in varied directions, so that the cord-winding assembly can be applied to different kinds of window blinds with different sizes and weights. Advantageously, when the cord-winding assembly of the invention is installed in any kind of window blind, the user is able to smoothly operate the window blind in an open or closed condition with less strength, as it can be readily appreciated by one having ordinary skill in the art.

In conclusion, the cord-winding assembly of the invention can be wound with a much larger length of the cord without having to increase the height thereof. Advantageously, the cord-winding assembly will not occupy a large space in the housing of the upper head rail of the window blind. Furthermore, since the cord-winding assembly of the invention consists of two spools and a cord only, the structure of the cord-winding assembly is simple. Based on this, the cord-winding assembly can be connected to other window components in a simple manner without using complex gear units as it does in the conventional structure. Advantageously, the cost is reduced, and convenient assembly is provided.

Although the invention has been described in detail with reference to its presently preferable embodiments, it will be understood by one of ordinary skill in the art that various modifications can be made without departing from the spirit and the scope of the invention, as set forth in the appended claims.

What is claimed is:

1. A cord-winding assembly of a window blind comprising:

a first spool having a first axis extending in an axial direction, wherein a plurality of first grooves is formed on an outer periphery of the first spool, wherein the plurality of first grooves is parallel to each other, wherein each of the plurality of first grooves has a circumferential length different from other first grooves, wherein the first spool has a large end and a small end, wherein the large end has a diameter larger than a diameter of the small end;

a second spool having a second axis extending in the axial direction, wherein the first and second axes are parallel to each other, wherein a plurality of second grooves is formed on an outer periphery of the second spool, wherein the second grooves are parallel to each other, wherein the second spool has a large end and a small end, wherein the large end of the second spool has a diameter larger than a diameter of the small end of the second spool, wherein the large end of the second spool is aligned with the small end of the first spool in a radial direction perpendicular to the axial direction, and wherein the small end of the second spool is aligned with the large end of the first spool in the radial direction perpendicular to the axial direction;

a spring assembly; and a spool assembly, wherein the spring assembly comprises two spring spools and a spring having two ends fixed to the two spring spools, respectively, wherein the two spring spools are parallel to each other, wherein the spool assembly comprises a first cord spool, a second cord spool and a spool cord having two ends fixed at the first and second cord spools, respectively, wherein the first cord spool is connected to one of the two spring spools of the spring assembly, and wherein the second cord spool is connected to the small end of the first spool.

2. The cord-winding assembly of the window blind as claimed in claim 1, wherein each of the plurality of second grooves has a circumferential length different from other second grooves.

3. The cord-winding assembly of the window blind as claimed in claim 1, wherein the first spool has at least one axial groove extending through the plurality of first grooves.

4. The cord-winding assembly of the window blind as claimed in claim 3, wherein the at least one axial groove comprises a plurality of axial grooves.

5. The cord-winding assembly of the window blind as claimed in claim 1, wherein the second spool has at least one axial groove extending through the plurality of second grooves.

6. The cord-winding assembly of the window blind as claimed in claim 1, wherein the first spool has at least one axial groove extending through the plurality of first grooves thereof, and wherein the second spool has at least one axial groove extending through the plurality of second grooves thereof.

7. The cord-winding assembly of the window blind as claimed in claim 1, wherein the first spool comprises a shaft tube portion extending through two ends of the first spool in the axial direction, wherein the plurality of first grooves extends in a radial direction perpendicular to the axial direction on the outer periphery of the first spool, wherein the second spool comprises a shaft tube portion extending through two ends of the second spool in the axial direction, and wherein the plurality of second grooves extends in the radial direction perpendicular to the axial direction on the outer periphery of the second spool.

8. The cord-winding assembly of the window blind as claimed in claim 1, further comprising a drive cord, wherein the first spool has a cord-retaining hole at the large end thereof, wherein the second spool has a cord-retaining hole aligned with the small end of the first spool in a radial direction perpendicular to the axial direction, and wherein the drive cord has two ends fixed in the cord-retaining holes of the first and second spools, respectively.

9. The cord-winding assembly of the window blind as claimed in claim 1, further comprising a drive cord, wherein both of the first and second spools have a cord-retaining hole at the large end thereof, and wherein the drive cord has two ends fixed in the cord-retaining holes of the first and second spools, respectively.

10. The cord-winding assembly of the window blind as claimed in claim 1, further comprising a pulley connected to the large end of the second spool.

* * * * *